United States Patent [19]

Lackey

[11] Patent Number: 4,989,869

[45] Date of Patent: Feb. 5, 1991

[54] GOLF TEE

[76] Inventor: Lamar Lackey, 1122 Colombian Rd., Homewood, Ala. 35209

[21] Appl. No.: 500,553

[22] Filed: Mar. 28, 1990

[51] Int. Cl.[5] ..... A63B 57/00

[52] U.S. Cl. ..... 273/33; 273/212

[58] Field of Search ..... 273/33, 201-212

[56] References Cited

U.S. PATENT DOCUMENTS

| | | | |
|---|---|---|---|
| 1,623,782 | 4/1927 | Dent et al. | 273/33 |
| 1,679,579 | 8/1928 | Lundy | 273/33 |
| 3,406,978 | 10/1968 | Johnson, Jr. | 273/207 |

*Primary Examiner*—Theatrice Brown

*Attorney, Agent, or Firm*—H. Jay Spiegel

[57] ABSTRACT

The present invention relates to an improved golf tee. The improved golf tee is seen to include a flexible upper half which may withstand impact by a golf club without breakage and a rigid lower half to facilitate insertion of the golf tee into the ground. The improved golf tee also includes a retratable metal spike therein which further imbeds the tee in the ground so as to prevent loss the tee during a golfer's drive. The improved golf tee may also include a levelling device therein to further assist a golfer in teeing up a golf ball in a level manner.

5 Claims, 1 Drawing Sheet

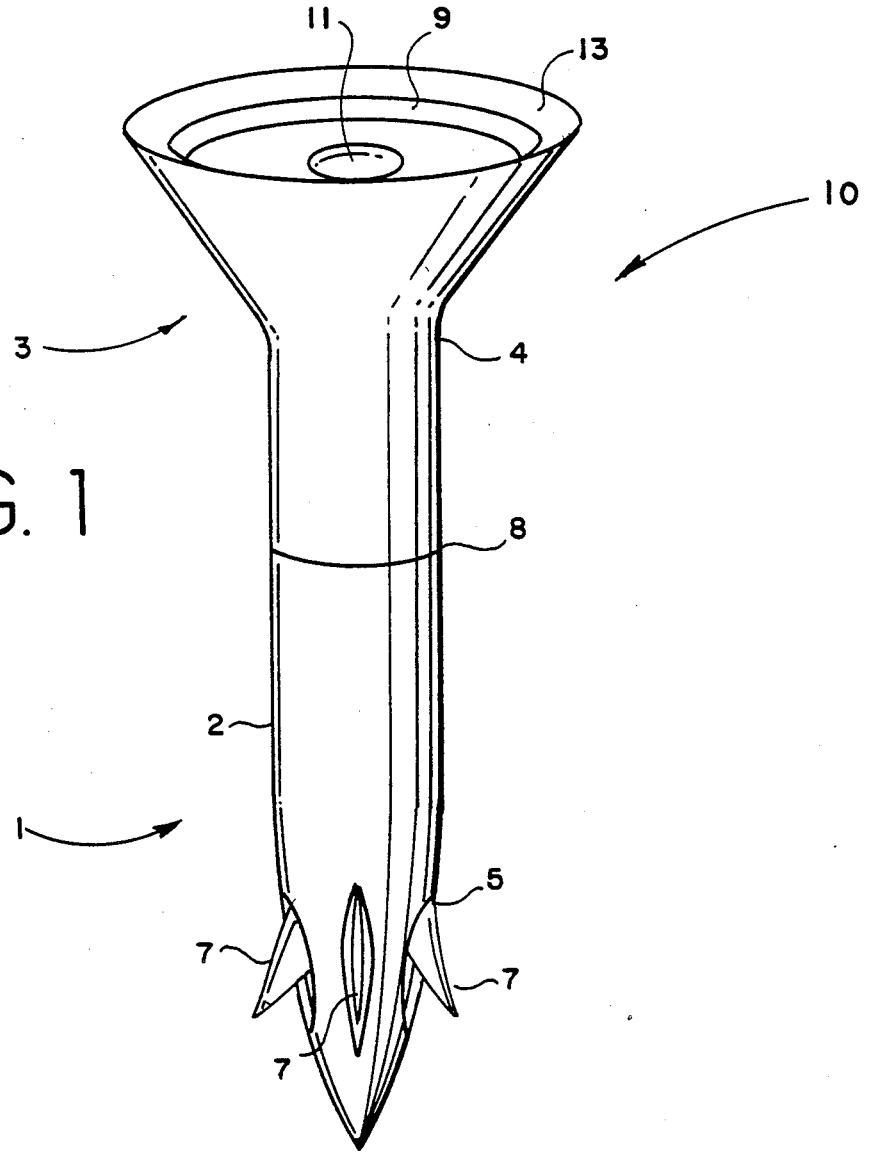
FIG. 1
FIG. 6
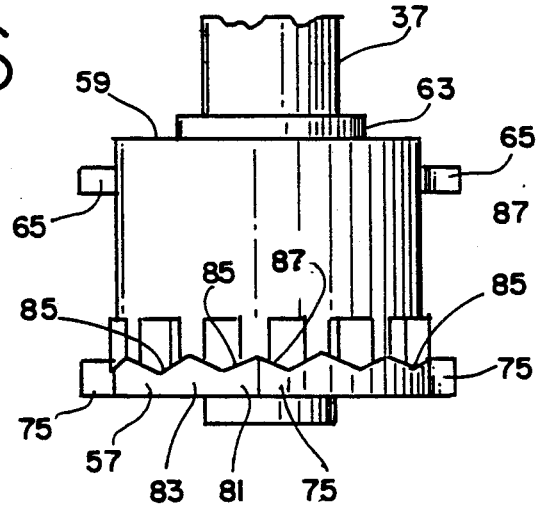

GOLF TEE

BACKGROUND OF THE INVENTION

The present invention relates to an improved golf tee. In the sport of golf, a recurring problem that exists for golfers is the loss of a golf tee during the drive. Specifically, a golf tee may be dislodged from its position within the ground due to the impact of a golf club. After the tee has become dislodged, it becomes airborne and lands in a location such that a golfer cannot find the tee or cannot spend the time searching for it. As such, a need has developed to provide a tee which resists being projected airborne during the golf swing. In response to this need, Applicant has developed an improved golf tee having retractable spring activated metal spikes which further imbed the tee in the ground to resist the tee being removed from the ground due to the impact of a golf club.

In the prior art, various designs of golf tees are known. U.S. Pat. No. 2,011,203 to Seiki discloses the concept of a disposable golf tee having a plug for inserting the disposable member into the ground. Of course, this is different from the teachings of the present invention in that the golf tee of Seiki does not include a retractable spring activated metal spike which further imbeds the golf tee into the ground. U.S. Pat. No. 1,623,782 to Dent et al. discloses the concept of a golf tee having a barb on the end thereof to further anchor the tee into the ground. The teachings of this patent are different from the present invention in that the Dent et al. patent does not teach or fairly suggest the retractable spring activated metal spikes of the improved golf tee of the present invention.

SUMMARY OF THE INVENTION

The present invention relates to an improved golf tee. The present invention includes the following interrelated aspects and features:

(A) In a first aspect, the improved golf tee of the present invention includes an upper half made of a flexible plastic which is designed to absorb impact and withstand breakage due to the impact of a golf club. The improved golf tee includes a lower half made of a more rigid material which facilitates insertion of the lower half of the golf tee into the ground. The lower half of the tee also includes a plurality of slots therein which permit the metal spikes to protrude therethrough when the metal spike mechanism is activated.

(B) The improved golf tee also includes a retractable spring activated metal rod having a plurality of spikes thereon. The metal rod may be activated after the tee has been inserted into the ground whereby the metal spikes pass through the slots in the lower half of the improved golf tee, engage the ground and further prevent the tee from being pulled from the ground and lost due to the impact of a golf club. The mechanism to provide a retractable spring activated metal rod having spikes thereon is similar to the mechanism used in a retractable ball-point pen.

(C) The improved golf tee may also include a bubble level or the like located on the upper half of the golf tee to assist a golfer in teeing a golf ball off in a level manner.

Accordingly, it is a first object of the present invention to provide an improved golf tee.

It is a further object of the present invention to provide a golf tee having a retractable spring activated metal spike to further imbed the golf tee in the ground and prevent losing the tee during use.

It is a yet further object of the present invention to provide a golf tee including a flexible plastic upper portion which absorbs impact and minimizes breakage of the tee.

It is a still further object of the present invention to provide a golf tee including a levelling device therein to further assist a golfer in teeing up a golf ball in a level manner.

These and other objects, aspects and features of the present invention will be better understood from the following Detailed Description of the Preferred Embodiment when read in conjunction with the appended drawing figures.

BRIEF DESCRIPTION OF THE DRAWINGS

FIG. 1 shows a perspective view of the improved golf tee.

FIG. 6 shows a side view of a portion of the structure shown in FIG. 2.

DESCRIPTION OF THE PREFERRED EMBODIMENT

Figure 2:
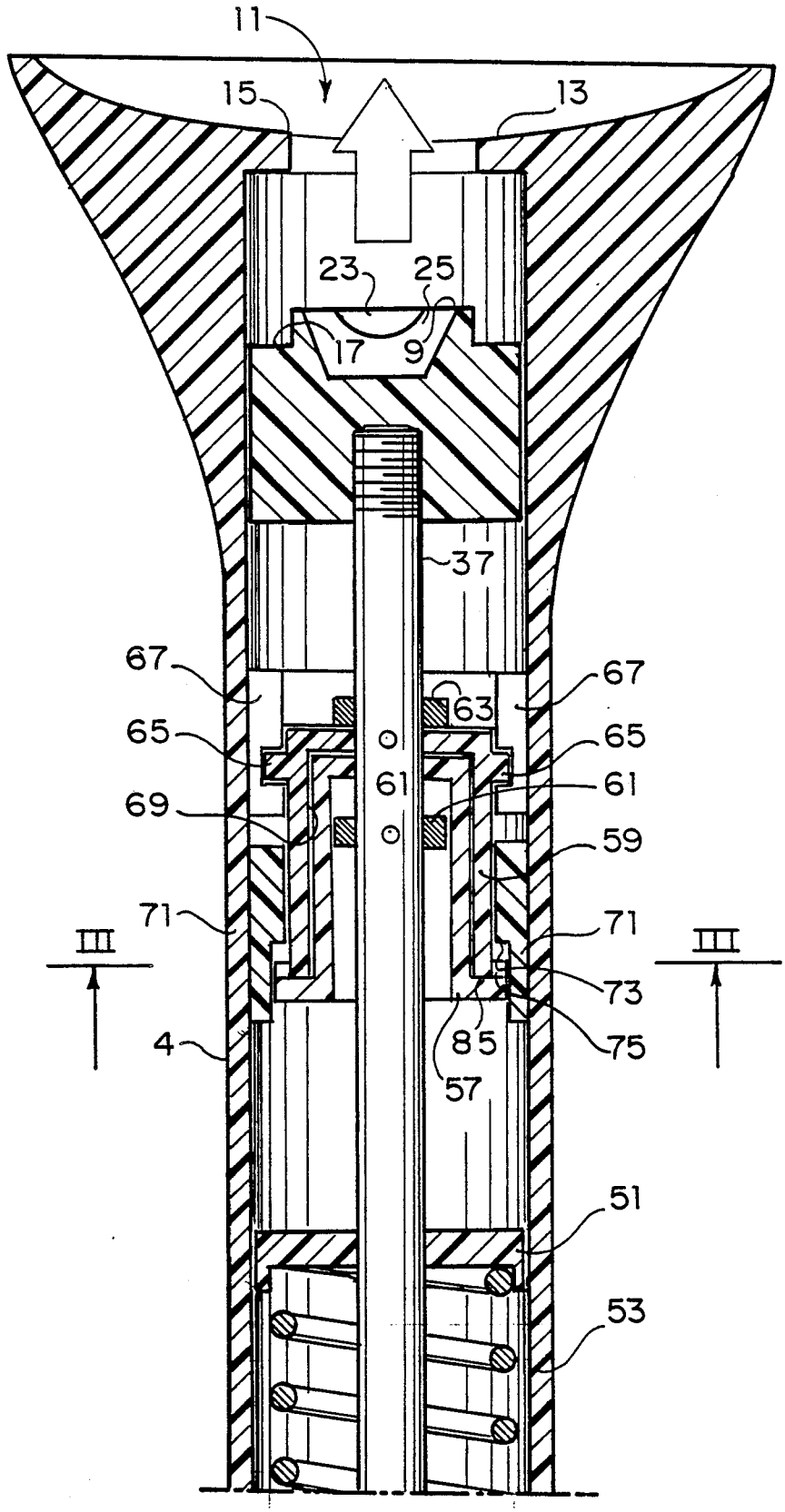
FIG. 2 shows a cross-sectional view through the upper half of the golf tee shown in FIG. 1.

With reference first to FIG. 1, the improved golf tee is generally designated by the reference numeral 10 and is seen to include a lower half 1 joined at the reference numeral 8 to an upper half 3. The lower half 1 includes a tapered housing 2 having a plurality of slots 5 therein. A plurality of metal spikes 7 are shown engaging the slots 5, the metal spikes 7 being in the lowered position to further imbed the golf tee into the ground.

Still with reference to FIG. 1, the upper half 3 is seen to include a housing 4 having an upper lip portion 13 and a retractable head portion 9. The retractable head portion 9 also may include a bubble level 11 therein. The movement of the spikes 7 and the retractable head portion 9 will be more fully described hereinafter.

Figure 3:
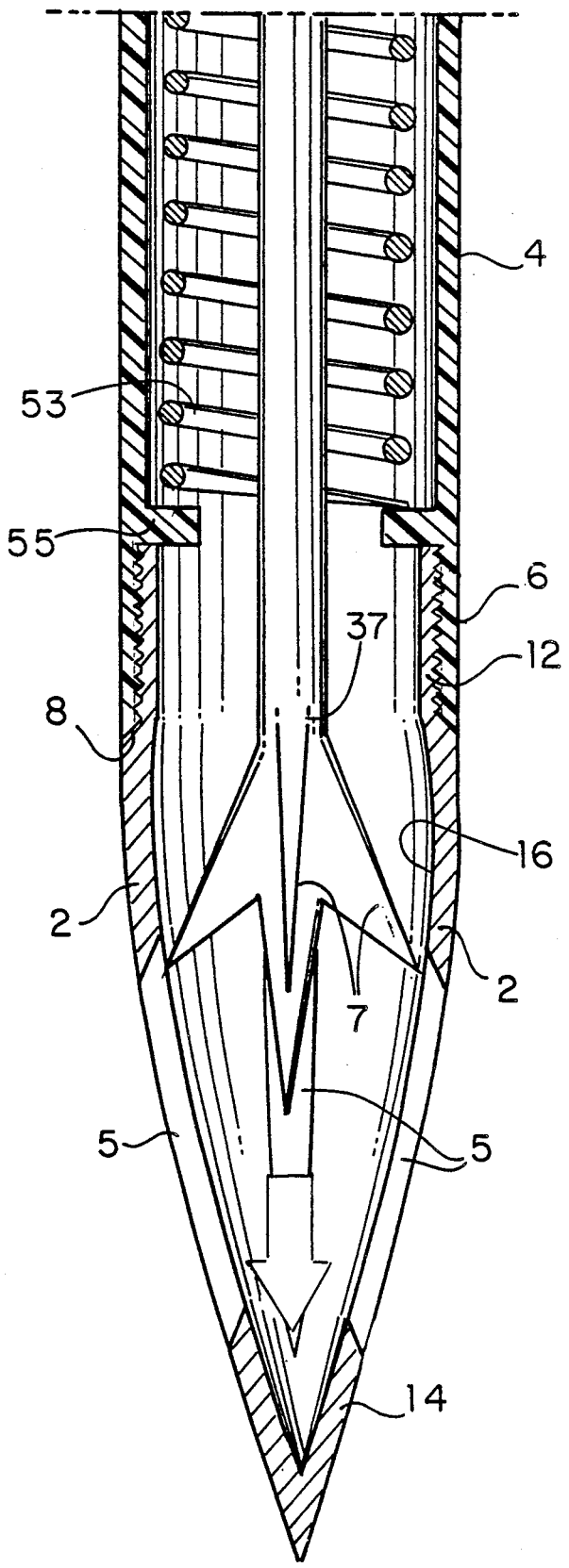
FIG. 3 shows a cross-sectional view of the lower half of the golf tee shown in FIG. 1 with the metal spikes retracted upward.

With reference to FIGS. 2 and 3, it is seen that the golf tee 10 includes a mechanism therein for selectively controlling the fixed position of the metal spikes 7. As seen in both FIGS. 1 and 2, a rod 37 extends upwardly and is attached at one end thereof to the retractable head portion 9 by a threadable connection 27. The rod 37 includes an annular washer 51 affixed thereto against which is resiliently engaged a spring 53 which bears at its other end against a shoulder 55 extending inward from the upper half housing 4. Thus, the spring 53 may bias the rod 37, the head portion 9 and metal spikes 7 upwardly as shown by the arrow in FIG. 2. It should be noted that FIG. 1 depicts the retractable head portion 9 in the downward position while FIG. 2 depicts the metal spikes 7 in the upward position.

The rod has attached thereto a pair of annular members 57 and 59. These members are attached to the rod 37 by virtue of a lower ring 61 and an upper ring 63 which may be mounted in surrounding relation to the annular members 57 and 59 by any suitable means such as screws, welding, threaded connections and the like. The annular member 59 includes a pair of radially outwardly extending tabs 65 which cooperate with the inwardly form guide ribs 67 so as to constrain the annular member 59 to reciprocate without rotating. It is noted that only one rib 67 is shown in each side of FIG. 2 but it should be understood that on each side of FIG. 2 two ribs 67 are formed, one on each side of the respective tab 65.

The annular member 57 is mounted within an opening 69 formed within the annular member 59. As may be understood with reference to FIGS. 2, 4 and 5, the interaction of the annular members 57 and 59 with each other and with the cylindrical housing 4 is similar to the actuation motion of a typical ball-point pen. In particular, with reference to FIG. 4, a plurality of inwardly extending protrusions 71 are formed on the inner walls of the housing 4. Each such structure 71 includes a recess 73 therein into which a protrusion 75 extending radially outwardly from the annular member 57 may be selectively inserted. Furthermore, as best seen in FIG. 4, spaces 77 exist between the structures 71 so that rotation of the annular member 57 about its axis by ⅛ of a turn in the view of FIG. 4 would result in the protrusions 75 being located within the spaces 77 so that the spring 53 may move the rod 37 and metal spikes 7 upwardly along the walls 79 of the structures 71 above the uppermost level of the recesses 73 thereof.

With further reference to FIG. 6, it is seen that the annular member 57 has an annular ring-like portion 81 having a plurality of pointed recesses therein designated by the reference numeral 83 and into which pointed protrusions 85 extending downwardly from the annular member 59 may interface. It is important to note that the protrusions 75 have angled cam surfaces 87 thereon which may interact with the protrusions 85 of the annular member 59 such that the interaction thereof when the rod 37 is moved downwardly causes rotation of the annular member 57 with respect to the annular member 59. Thus, in the view of FIG. 2, when the retractable head portion 9 is pushed downwardly by a user, the upper ring 63 fixedly mounted to the rod 37 will pull the annular members 57 and 59 together until the protrusion 75 of the annular members 57 are released from the recesses 73 whereupon the interaction between the cam surfaces 87 of the protrusions 75 and the protrusions 85 of the annular members 59 will result in the annular member 57 being rotated ⅛ of a turn with respect to the annular member 59 which may not rotate due to the interaction of the tabs 65 and the ribs 67. Thus, with the protrusions 75 assuming the phantom line position shown in FIG. 5, the spring 53 may reciprocate the rod 37 and metal spikes upwardly until the protrusions 75 are in the phantom position shown in FIG. 5.

Figure 4:
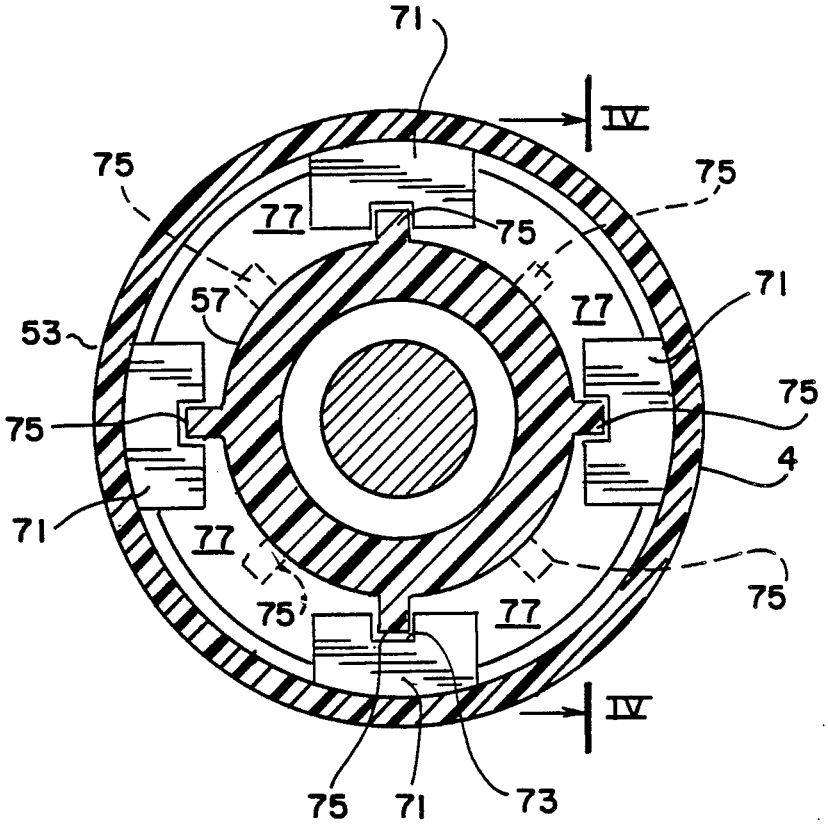
FIG. 4 shows a sectional view along the line IV—IV of FIG. 2.
Figure 5:
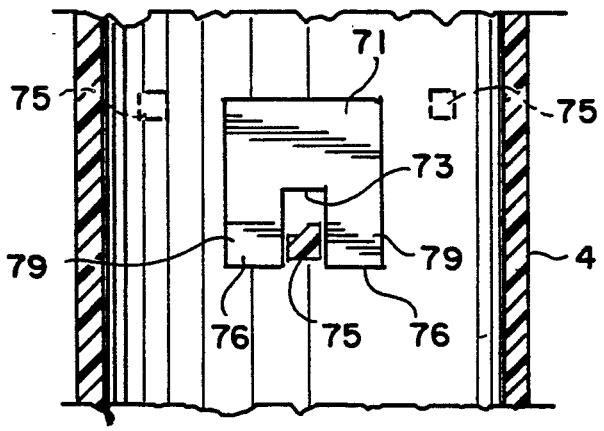
FIG. 5 shows a cross-sectional view along the line V—V of FIG. 4.

With the metal spikes in the withdrawn position as best seen in FIG. 3, a further reciprocation of the retractable head portion 9 and rod 37 downwardly against the upward force of the spring 53 will cause the protrusions 75 to be located below the bottom surface 76 (FIG. 5) of the structures 71 whereupon the interaction of the cam surfaces 87 of the protrusions 75 and the pointed protrusions 85 of the annular member 59 will result in a further rotation of the annular member 57 with respect to the annular member 59 ⅛ of a turn to thereby align the protrusions 75 with the recesses 73 as shown in FIGS. 4 and 5, whereupon the rod 37 and metal spikes 7 will be locked in its downward position, the metal spikes 7 thereby protruding through the slots 5 in the lower half housing 2, thereby further engaging the ground and the improved golf tee therein.

With reference to FIG. 3 again, the upper housing 4 is seen to be threadably connected to the lower housing 2 to facilitate removal of the various components within the improved golf tee. The upper half housing 4 includes a threaded end portion 6 which engages a complementary threaded end portion 8 of the lower housing 2, shown by the reference numeral 12.

With reference again to FIG. 1, the retractable head portion 9 includes a lower lip portion 17 thereon, which prevents the retractable head portion 9 and rod 37 from sliding out of the upper housing 4.

The retractable head portion 9 may also include a bubble level 11 therein. The bubble level 11 is seen to include an air bubble 23 and the levelling circle 25 which interacts with the air bubble 23 to determine whether the golf tee is level or not. Of course, other known levelling devices may be utilized in place of the bubble level 11 as depicted in the retractable head portion 9.

With reference to FIG. 3 again, the metal spikes 7 are shown integrally attached to the metal rod 37. However, the metal spikes 7 may be separable components and may be removably attachable to the metal rod 37 by pins or other fastening means.

Regarding the materials of construction for the improved golf tee, the upper half of the golf tee should be constructed out of primarily flexible plastic components that are capable of absorbing the impact of a golf club without breaking. The lower half of the golf tee should be made out of a material having sufficient strength to penetrate the ground when the tee is being inserted therein. A preferred material for the lower half of the golf tee would be a metal or rigid plastic material. A preferred material for the metal spikes and the rod attached thereto would be a metal material, the metal material providing sufficient strength to penetrate and engage the ground when the spring activated retracting mechanism is employed.

In use, prior to insertion of the improved golf tee into the ground, the retractable head portion 9, rod 37 and metal spikes 7 should be in the upward position, that is, the position depicted in FIG. 2. Once the tee has been inserted into the ground, the retractable head portion 9 may be pushed downwardly thereby projecting the metal spikes 7 through the slots 5 in the lower half housing 2 and further engaging the tee into the ground. Once the golfer has completed his swing, the retractable head portion 9 may be pushed downwardly again, thereby retracting the rod 37 and metal spikes 7 upwardly and then removing the tee from the ground. Alternatively, the entire improved golf tee may be removed from the ground and then the metal spikes may be retracted by the downward motion of the retractable head portion 9.

As such, an invention has been disclosed in terms of a preferred embodiment thereof which fulfills each and every one of the objects of the present invention as set forth hereinabove and provides a new and improved golf tee of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved golf tee comprising:

(a) an upper housing made of flexible material capable of withstanding impact from a golf club without breaking, said upper housing including a cupped portion for holding a golf ball;

(b) a lower housing made of a rigid material, said lower housing including a tapered portion having a plurality of slots therein, said lower housing being removably connectable to said upper housing;

(c) a spike assembly including a metal rod, said metal rod having a head portion attached at one end and a plurality of spikes attached at the other end; and (d) a spring loaded locking means for releasably locking said spike assembly between a first position and a second position, wherein each one of said metal spikes extends through each one of said slots in said lower housing in said first position and each one of said spikes is within said lower housing in said second position;

(e) whereby said spikes, when said spike assembly is in a said first position, permit said improved golf tee to further resist displacement from an inground position due to impact from a said golf club.

2. The invention of claim 1, wherein said head portion further includes a levelling device therein.

3. The invention of claim 1, wherein said lower housing is made out of a rigid plastic material.

4. The invention of claim 1, wherein said lower housing is made out of a metallic material.

5. The invention of claim 1, wherein said lower housing is threadably connected to said upper housing.

* * * * *